United States Patent [19]

Danielsson

[11] Patent Number: 4,889,194

[45] Date of Patent: Dec. 26, 1989

[54] METHOD AND A DEVICE FOR DEEP HOLE DRILLING

[76] Inventor: Per Danielsson, Hantverkaregatan 13, S-341 00 Ljungby, Sweden

[21] Appl. No.: 275,641

[22] Filed: Nov. 22, 1988

Related U.S. Application Data

[63] Continuation of Ser. No. 60,391, filed as PCT SE86/00430 on Sep. 26, 1986, published as WO87/02091 on Apr. 9, 1987, abandoned.

[30] Foreign Application Priority Data

Sep. 27, 1985 [SE] Sweden ..... 8504473

[51] Int. Cl.[4] ..... E21B 10/08

[52] U.S. Cl. ..... 175/65; 175/307; 175/331; 175/319; 175/320; 175/383

[58] Field of Search ..... 175/307, 331, 379, 381, 175/382, 383, 386, 344, 327, 413, 258, 259, 65, 315, 319, 82, 83, 320

[56] References Cited

U.S. PATENT DOCUMENTS

| | | | |
|---|---|---|---|
| 2,203,747 | 6/1940 | Sandstone | 175/379 |
| 2,839,270 | 6/1958 | McCune et al. | 175/83 |
| 3,847,236 | 11/1974 | Coalson | 175/383 |
| 4,394,882 | 7/1983 | Ritter et al. | 175/89 |

FOREIGN PATENT DOCUMENTS

| | | | |
|---|---|---|---|
| 542092 | 6/1957 | Canada | 175/82 |
| 2438733 | 2/1976 | Fed. Rep. of Germany . | |
| 754037 | 8/1980 | U.S.S.R. | 175/383 |

OTHER PUBLICATIONS

Petroleum Engineering, vol. 47, Sep. 1975, pp. 137, 139.

*Primary Examiner*—Hoang C. Dang
*Attorney, Agent, or Firm*—Ladas & Parry

[57] ABSTRACT

A device for drilling deep holes in the ground has at least two axial drill bits and an equal number of plates each having three shafts axially interconnecting the plates. Two of the shafts are rigidly attached to both plates and the third shaft is pivotably attached to both plates. The two rigid shafts are separable from the upper plate by pulling a locking pin separating a telescopic head of each shaft from the plate. At the separation, the shafts are telescopically shortened by springs and the drilling liquid is automatically shut off to the worn-out drill bit and opened to the new drill bit. The remaining third shaft eccentrically interconnects the plates, whereby the lower worn-out drill bit, at rotation, wears a semicircular evacuation pocket in the wall of the hole. The third shaft is successively pivoted outwards until it forms an angle of e.g. 80° with the axis of the hole. An axle pin having rectangular cross-section retains the upper end of the third shaft via a sleeve with a slit. The slit has such a dimension that the narrowest cross-section of the axle pin can pass through the slit at said angle for releasing the third shaft from the second plate for placing the worn-out drill bit with three legs and plate in the evacuation pocket thus formed.

10 Claims, 5 Drawing Sheets

METHOD AND A DEVICE FOR DEEP HOLE DRILLING

This is a continuation of co-pending application Ser. No. 060,391, filed as PCT SE86/00430 on Sep. 26, 1986, published as WO87/02091 on Apr. 9, 1987, now abandoned.

FIELD OF INVENTION

The invention relates to a method for drilling deep holes and a device for performing the method. The invention relates more specifically to a method and a device for exchanging drill bits on a drilling rod in situ in a hole when one drill bit is worn out without lifting the whole drilling rod and drill bits up to ground level and, thus, without all drawbacks thereof.

PRIOR ART

Drilling deep holes into the earth is of very great interest today for drilling for oil, natural gas and geothermal energy, on-shore as well as off-shore. Drilling such deep holes is normally done by sinking a drill bit on the bottom of a drilling rod in order to cut or crush the material at the drill bit at the bottom of a hole thus formed. The crushed material, called drilling mud, is washed up to ground level by a drilling fluid, which can be water, a mineral oil, compressed air, etc. As such drilling proceeds downwards, the drilled hole is lined with a steel tube.

One well-known drilling technique uses a roller-type drill bit having, for example, three rollers with hard metal alloy tips evenly distributed on their surfaces. These rollers are pressed with great force against the bottom of the hole and rolled therearound, whereby the hard metal alloy tips break or crush the material at the bottom of the hole. This material is very variable in hardness, because it ranges from primary rocks through unfixed species of stones such as sandstone to gravel and soil. The drill speed depends on the hardness of the material.

Another well-known drilling technique is hammer drilling, wherein a pneumatically driven hammer produces the material cutting in the drill hole. This drilling technique is limited, however, in how deep a hole can be drilled.

In the deep hole drilling, therefore with a roller type bit, however, the drill bit wears out and must be exchanged after drilling a certain, lesser, distance. What wears out in the drill bit is the bearings of the rollers and the hard metal ally tips, which are, ordinarily, inserts. Therefore, bearings of the best quality and hard metal alloy tips of the highest structural strength and quality are used. In some applications, the hard metal alloy tips are even replaced with diamonds, but this makes the drill bit more expensive. As to the roller bearings, they are exposed to a very harsh environment. In deep hole drilling, the pressure of the drilling mud and fluid column in the hole is very high and their sludge abrasive. These facts place extremely high leakage demands on the bearings, because if the sludge enters the bearings, they will be immediately destroyed.

Even though elaborate techniques are used to protect a drill bit from such wear and, thereby, extend its life, however, it will sooner or later wear out. Then, as mentioned above, the drilling rod has to be taken up so the drill bit can be changed at ground level. This operation is very time consuming and, therefore, causes a lengthy drilling interruption. In some cases, too, it can be very difficult or impossible to take up the drilling rod, e.g. when drilled hole has substantial bends.

SUMMARY OF THE INVENTION

An object of the invention is, therefore, to exchange a drill bit underground, without taking up the drilling rod, whereby a long drilling interruption is avoided and the drilling time is considerably shortened.

Another object of the invention is appropriately positioning the worn-out, exchanged drill bit. The drilled hole has a diameter only as big as the drill bit and, therefore, there is no room for lateral exchange between the worn-out drill bit and a new one positioned thereabove.

As to the first end, exchanging the drill bit underground, at the bottom of the hole, the invention provides two or more bits as integral parts of a drilling device used at the bottom of the hole. Thus, when a first, lowermost drill bit wears out, there is another drill bit closely thereabove, ready for use.

As to the second end, positioning the worn-out drill bit, it is well known that a bit can so wedge in the hole that it cannot be disengaged and has to be left in the hole. The new drill bit put on the drilling rod after it has been taken up to ground level is then sunk down the hole, drills a side hole at a small angle near the bottom of the original hole with the wedged-in bit, and then proceeds downwards beside the old wedged-in bit. This technique can also be used with the drilling device of the present invention, but it is still difficult to drill such a side hole and the resulting bending of the drill is a drawback. According to the invention, therefore, a side hole is provided for the worn-out drill bit, to put it out of way. Drilling with the newly-exchanged bit then continues along the original hole axis.

Thus, according to the present invention, there is provided a method of drilling a hole in the ground, and a drilling device to be attached to a driven drilling rod, the drilling device having at least two, axially successive bits, one above the other. When the first drilling bit is worn-out, the bits are exchanged in situ at the bottom of the drilled hole.

For this, the drilling device has a separating device operable in two steps. When the bits are to be exchanged, the first step of the separating device is activated while the worn-out bit continues rotation to cause the drilling device to drill a side hole or pocket. When the worn-out bit has drilled itself into the side hole or pocket, it is released in the second step from the drilling device, and the next bit thereof starts drilling in the original hole.

Preferably, the separating device for each exchangeable bit has two plates and at least two shafts, which connect one plate on the worn-out bit with the second plate on the bit positioned thereabove. The shafts pivot the one plate with the worn-out bit to a predetermined angle, e.g. 80°, to drill the side hole or pocket for the worn-out bit, and then release the shafts from connection with said corresponding second plate positioned thereabove. Then, the first drilling bit with pertaining plate shaft is left in the evacuating pocket thus formed, and drilling in the original hole resumed with the new bit on the second plate. Suitably, each shaft is telescopic, so that the shafts will shorten in length when released from connection with the second plate to be out of the way of the new bit thereon.

According to a preferred embodiment of the invention, the second shaft is connected to the second plate by an axle pin having essentially a rectangular cross section on the second plate and a sleeve with a slit having a width, which corresponds to the narrowest dimension of the axle pin on the second shaft. The shaft and the sleeve disengage from the second plate and axle pin when the shaft has been pivoted radially outwards to said predetermined angle, because the axle pin only then can pass through said slit in said sleeve.

The invention also relates to a drilling device for performing the method according to the invention. The drilling device is attached to and driven by a drilling rod. It comprises at least two drill bits, one axially above the other. An eccentric device adapts it to make a cone-shaped evacuating pocket in the side of the hole at activation with the lowermost worn-out bit. A releasing device disengages the lowest drilling bit to leave it in the cone-shaped evacuating pocket for further drilling in the hole with the second drilling bit positioned thereabove.

During the time when the evacuating pocket is provided, the cut material will sink to the bottom of the hole. Thus, when the bits are so exchanged, the drilled hole must be sufficiently deep, so that the volume of the hole below the drilling lining at least corresponds to the volume of the evacuating pocket.

BRIEF DESCRIPTION OF THE DRAWINGS

The invention is described below in more detail with reference to a preferred, exemplary embodiment of the invention shown in appended drawings in which.

DETAILED DESCRIPTION OF THE PREFERRED EMBODIMENT

Figure 1:
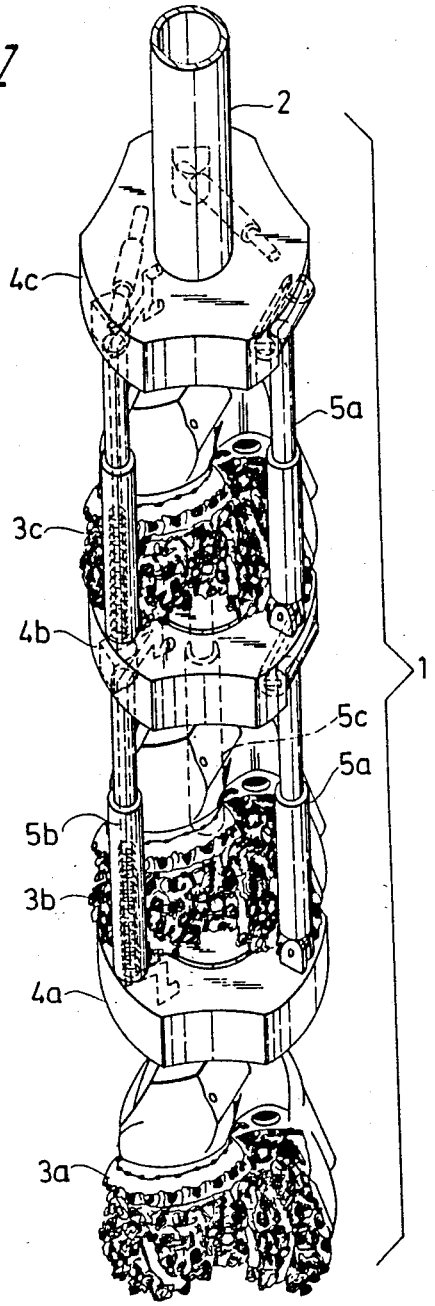
FIG. 1 is a perspective view of a drilling device according to the invention.

In FIG. 1, the drilling device 1 according to the invention is shown to have an upper portion attached to a drilling rod 2. The drilling rod is driven by a driving device (not shown) positioned at the ground level, e.g. a drilling platform or a ground-based station. Of course, the driving device can also be positioned under ground in a cave, tunnel, etc.

Three roller drill bits or crowns 3*a*, 3*b*, 3*c* are successively aligned with each other, one below the other, and operatively connected to the drilling rod 2, so that the lowermost crown 3*a* initially performs the drilling work. The crowns are of a well-known construction and, therefore, need not be described in more detail here. The drilling device could also use other types of drill bits or comparable material-cutting devices.

The bits 3*a*, 3*b*, 3*c* are successively arranged one after the other on one side of respective transversal plates 4*a*, 4*b*, 4*c*. The opposite side of one, uppermost plate 4*c* is connected to the drilling rod 2 and the opposite sides of the two lowermore plates 4*a*, 4*b* each have a damping device 6 (FIG. 2) for receiving drilling edges of the preceding uppermore bits 3*b*, 3*c*, whereby the bits 3*b*, 3*c* space the plates 4*a*, 4*b*, 4*c* as long as they are connected. Each two successive plates 4*a*, 4*b*, 4*c* are respectively interconnected with three telescopic shafts 5*a*, 5*b*, 5*c*, but it is easy to see that the number of shafts can vary depending on the application and demand for structural strength. The plates are interconnected with the shafts, but are maintained at a predetermined distance from each other by drilling bits between the plates and the damping devices.

Figure 2:
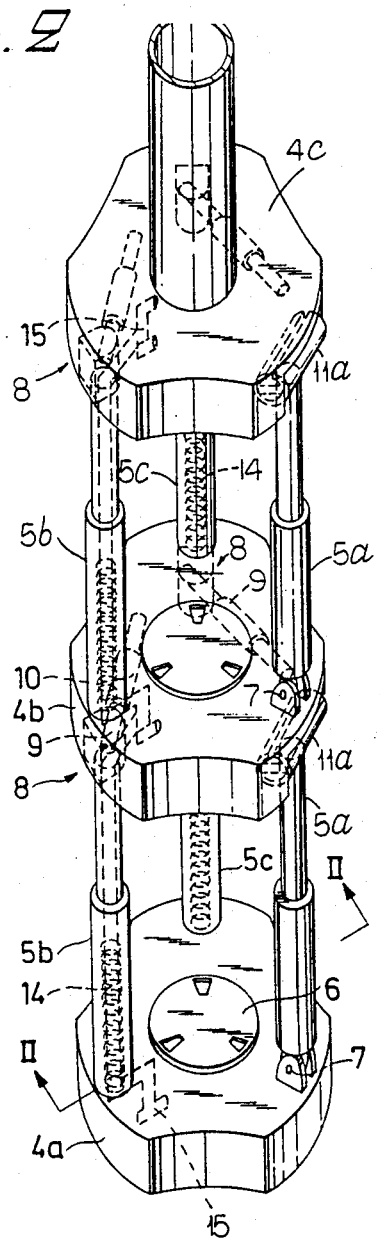
FIG. 2 is a perspective view of the drilling device of FIG. 1, but with drilling bits thereof removed.

The damping devices 6 are on the upper sides of the plates 4*a*, 4*b*, as appears from FIG. 2. Each has recesses for the three rollers of the bit 3*b*, 3*c* positioned thereabove. The operation of the damping devices is to damp the forces, which are exerted in the axial direction of the drilling rod and to transfer a rotation moment between the plates in conjunction with the telescopic shafts.

As appears from FIG. 1, the bits 3*b* and 3*c* are positioned within and protected by the border of the plates and the shafts thereabout, so that they are not worn during drilling with bit 3*a*.

The rotation moment from the drilling rod 2 is transferred by the plates and shafts in conjunction with the bits 3*c* and 3*b* to the bit 3*a*. The drilling fluid flows from the drilling rod to the bits via channels 15 in the plates and inside one, interconnected telescopic shaft 5*b* (as shown in phantom in FIG. 2) downwards to the then lowermost bit, each bit having holes (not shown) for receiving it. After flowing from the lowermost bit, as known, the drilling fluid with the drilling mud flows up, past indentations in the peripheries of the plates and between the hole lining (not shown) and the drilling rod 2, to the ground. The drilling fluid is powered by a suitable pump device at the ground level.

In FIG. 2, the drilling unit of FIG. 1 is shown without the bits 3*a*, 3*b*, 3*c* to show more clearly other details, such as the damping device already described. Thus, in FIG. 2, it is shown that the shafts 5*a* are pivotably attached to their respective lower plates 4*a*, 4*b* with pins 7. The same shafts 5*a* are fastened to their respective upper plates 4*b*, 4*c* with a pivotable coupling at 11*a*, which will be described in more detail below. Each one of the two other shafts 5*b* and 5*c* are rigidly fastened to their respective lower plates 4*a*, 4*b* and releasably connected to upper plates 4*b*, 4*c*, the latter by respective telescopic heads at 8 (only one indicated in FIG. 2), as more clearly appears from FIGS. 3 and 4. Each telescopic head is retained in position with a locking pin 9 which is controlled by a piston 23 in a cylinder 10 (only one each indicated). The piston and cylinder are a locking device, which retracts the corresponding locking pin 9 and releases the telescopic head 8 from the corresponding plate 4*b*, 4*c*.

Figure 5:
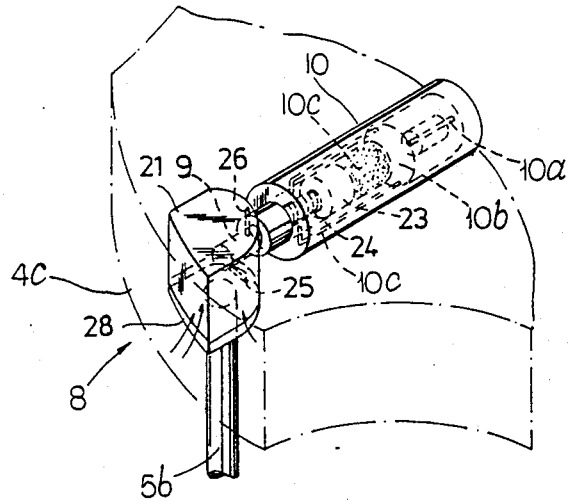
FIG. 5 is a perspective view of still another, locking and trigging portion of the drilling device of FIG. 1.
Figure 6:
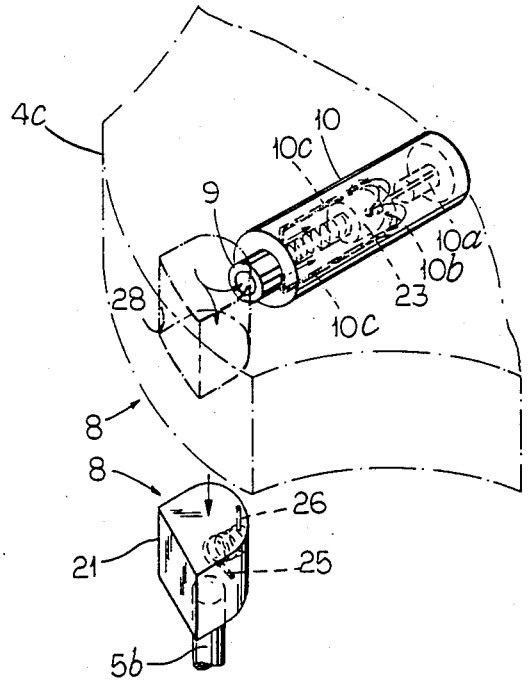
FIG. 6 is a perspective view of the portion of the drilling device of FIG. 5 in a different position.

According to the present invention, the locking device and a triggering impulse receiver (not shown) therefore are hermetically enclosed in plates 4*b*, 4*c*, as shown representatively in FIGS. 5 and 6 for plate 4*c* and shaft 5*b*. Accordingly, in order to release a head 21 of the telescopic shaft from a locking profile 28 in the plate 4*c* receiving it, the impulse receiver triggers a spring-activated punching pin 10*a*, which then liberates compressed gas from a capsule 10*b*. The gas is conducted in the channels 10*c* to the other side of the piston 23, where the locking pin 9 prevents the telescopic head 21 from leaving the profile 28 in plate 4*c*. The gas pressure and a spring 24 push the piston 23 to pull the locking pin 9 from the head 21. A channel 25 provides the gas pressure to the end of the locking pin 9 in the head 21 to free the pin from the head with the gas pressure, too. At that time, all the forces on the locking pin 9 cooperate in one direction to pull the locking pin 9 form the head. When the locking pin 9 has, thus, passed a channel 26, the gas pressure is also directed around the telescopic head 21, for pressure equalization inside and outside of the locking profile 28. Then, with the locking pin 9 out of its hole in the telescopic head 21, the telescopic head 21 is pulled from its seat in the locking profile 28 by a spring in the telescopic shaft 5*b*, which pushes the telescoping housings of the shaft into each other to shorten the shaft. The other shafts 5*c* are shortened in the same way, but not the shafts 5*a*.

Each entire locking device, which holds the telescopic heads 21 in position, including its impulse receiver is, therefore, hermetically enclosed in a plate. The impulse receiver can be remote controlled in a number of different ways, as by radio waves, microwaves, ultrasonic waves or any other form of impulses which would propagate inside the drilling rod when filled with liquid or evacuated. The locking pin can be driven pneumatically as described, or hydraulically or mechanically, which can be arranged in a suitable way.

Figure 2A:
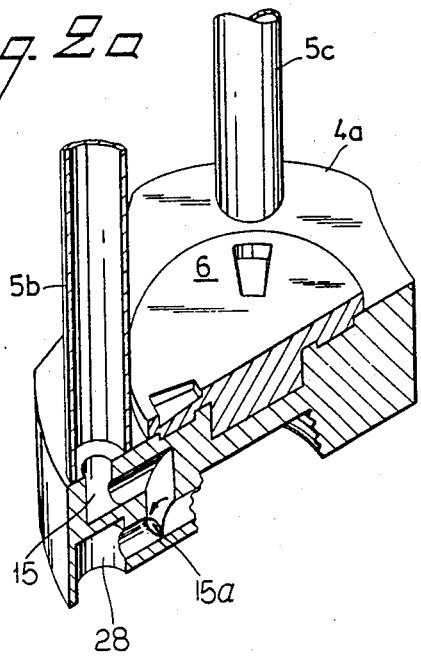
FIG. 2*a* is perspective view of a portion of the drilling device of FIG. 1 in a cross section taken on line II—II in FIG. 2.

As mentioned before, the drilling fluid is automatically shut off to the worn-out drilling bit 3*a* in the first step of its release. For this, the telescopic head 21 influences a mechanism (not shown), which pulls a flap 15*ax* in FIG. 2*a* corresponding flaps in uppermore plates 4*b*, 4*c* (not shown) in the channel 15 for the drilling fluid in the way shown by the arrow in FIG. 2*a* so that the fluid is directed to the drilling bit (not shown in FIG. 2*a*) presently used. At bit exchanging, when the corresponding telescope head 21 is leaving its seat (locking profile 28) due to the contracting movement of a telescopic shaft, the mechanism so changes the position of the flap, so that the drilling fluid is switched off to the worn-out drilling bit and opens to the next new one. Thus, each bit in the drilling device is associated with at least one shaft 5*b* provided with a channel cooperative with a channel 15 in the plates having the flap mechanism or valve device designed therefor.

When a worn-out bit, e.g. bit 3*a*, is to be changed, this takes place according to the invention in the following way.

Figure 3:
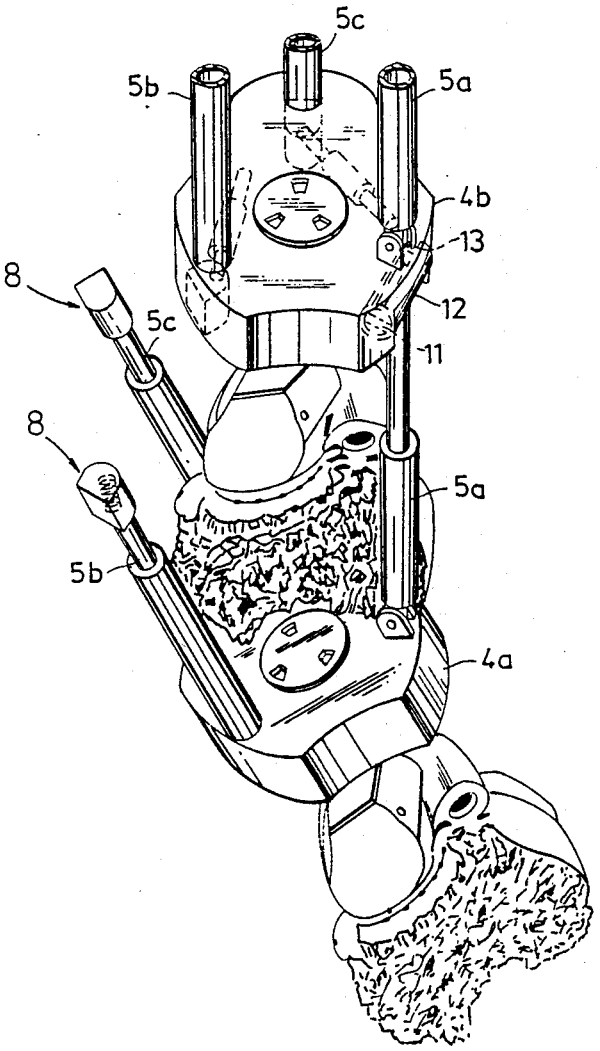
FIG. 3 is a perspective view of another portion of the drilling device of FIG. 1 in a different position.

Firstly, the rotation of the drilling device 1 by the drilling rod 2 is stopped and, possibly, the drilling hole is washed free from cuttings. Then, an impulse signal is sent to the impulse receiver in plate 4*b*, which activates the two locking devices therein to pull their locking pins 9 from the corresponding telescopic heads at 8 of shafts 5*b* and 5*c*. The drilling bit 3*a* and the plate 4*a* thereof are now only connected to the plate 4*b* by the shaft 5*a*. Each of shafts 5*b*, 5*c* is provided with a spring 14, which telescopically shortens the shafts. The drilling device is then put into slow rotation. The worn-out bit 3*a*, the plate 4*a* and the shafts 5*b* and 5*c* are now eccentrically hung by the shaft 5*a*, however. This and the rotation forces said elements outwards, towards the wall of the drilled hole. The shafts 5*b* and 5*c* no longer prevent such a movement. The shaft 5*a* is pivotably attached to both the plate 4*a* and the plate 4*b*, so it does not prevent such movement outwards, either. The worn-out drilling device thus makes a cone-shaped enlargement in the wall of the hole. This process is schematically shown in FIG. 3, which shows the worn-out bit directly after release of the shafts 5*b* and 5*c*. From the same FIG. 3, it also appears how the free ends of the shafts 5*b* and 5*c* will cut into the other side of the drilling wall and scratch and wear material out therefrom. However, the most useful work will be performed by the worn-out drilling bit itself.

As the drilling device continues to rotate, the cone-shaped enlargement is made progressively bigger, and the shaft 5*a* makes a wider angle with the plate 4*b*. The rotation speed is also slowly increased during the process, so that the centripetal force will increase, and thus, the material cutting of the worn-out bit 3*a* produces a ring-shaped evacuating pocket. The joint between the shaft 5*a* and the plate 4*b* consists of an axle pin 11 in the plate 4*b* having an obliquely-narrowest cross section at a predetermined angle and a sleeve 12 provided with a slit 13. The oblique narrowest cross section of the axle pin 11 appears from FIGS. 3 and 4, whereas the sleeve 12 is there shown to have a cylindric cross section with the slit 13 having a dimension circumferentially of the cylindric sleeve corresponding to the narrowest cross section of the pin. Thus, the sleeve is released from the pin when the narrowest part of the pin is aligned with the slit as the shaft pivots the sleeve on the pin as the bit progressively produces the evacuation space.

Figure 4:
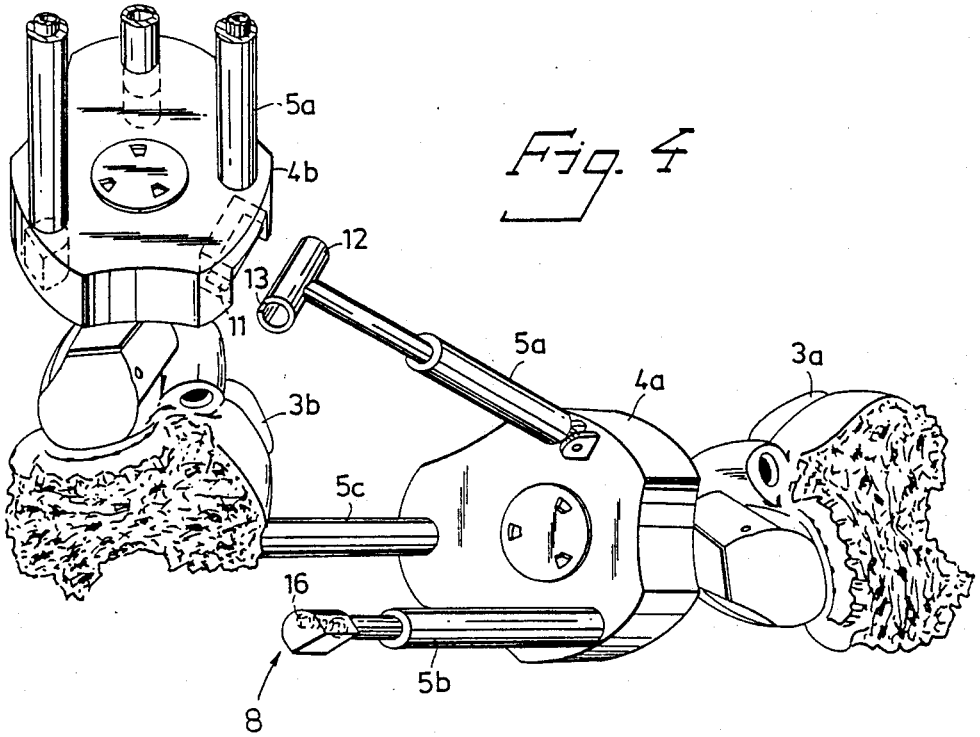
FIG. 4 is a perspective view of the portion of the drilling device of FIG. 3 in different final position.

At the starting position, the slit 13 of the sleeve 12 is positioned in its highest position. As the shaft 5*a* is angled outwards from the vertical line during the later, bit-exchanging rotation thereof, the slit of the sleeve is displaced towards the narrowest cross section of the axle pin. At the predetermined angle of the inclination of this, narrowest cross section of the axis pin, the slit 13 of the sleeve 12 is aligned with the narrowest part of the axle pin. Since the width of the slit 13 is as large as the narrowest part of the axle pin, the sleeve 12 is pulled from the axle pin 11 as its telescopic shaft 5*a* then shortens as is shown in FIG. 4.

The diameter of the pocket can be further increased in the following way. For the sleeve 12 to leave the axle pin 11, even when aligned, the sleeve must overcome a certain frictional drag of the slit 13 on the pin 11, which is attained by increased rotation speed. During this period, when the rotation speed is increased, the centrifugal force lengthens the telescopic shaft 5*a*, which is provided with a double spring action for this. The worn-out drilling bit 3*a* is then wearing material about the hole essentially in the radial direction, increasing the diameter of the pocket, whereby a ring-shaped slit is formed. When the centrifugal force is as large as the friction drag, the sleeve 12 slips over the axle pin 11.

Until this moment, torque for the rotary movement has been transferred by the axle pin 11 to the sleeve 12 of the shaft 5*a* and from the shaft to the plate 4*a* and the worn bit 3*a* for drilling on the side of the hole.

The ring-shaped evacuating pocket thus made has then at least achieved a sufficient dimension to be able to accommodate the worn-out drilling bit 3*a* with plate 4*a* and pertaining shafts 5*a*, 5*b*, 5*c*. When the sleeve 12 is released from the axle pin 11, the torque transfer by this joint is discontinued and the bit 3*a* stops in the evacuating pocket with its plate 4*a* and telescopic shafts 5*a*, 5*b*, 5*c* forever.

Rotation of the drilling rod is then stopped, and a drilling lining is pressed to the bottom of the drilled hole, whereby the evacuating pocket is sealed off from the hole. As mentioned above, the springs 14 shorten the telescopic shafts 5*b*, 5*c* as they pull their telescopic heads 21 from their locking profiles 28, so that the shafts 5*b* and 5*c* will be out of the way, in the pocket, for this. Shaft 5*a* is still elongated during the entire pocket-making process, however, due to gravitation and centrifugal forces. When the sleeve 12 passes off the axle pin 11, the spring 14 in shaft 5a shortens it for final keeping, too. The new drilling bit 3b is then lowermost in the drilling device, too, and drilling the hole can start again therewith.

In FIG. 1, a drilling device having three bits has been shown, but according to the invention, a drilling device can operate with as few as two bits, and the upper limit for the number of bits only depends on the application. Accordingly, for example, six drilling bits can be put in a line.

In FIG. 2, there is shown a channel system 15 for the drilling fluid, but it is only one example of such a channel system.

In FIG. 4, the shaft 5b is shown with another spring 16, which facilitates the removal of the locking pin 9 and the release of the telescopic head 8 from the plate 4b. Instead of springs 14, 16, pneumatic or hydraulic force transducers can be used for telescoping the legs or shafts.

The drilling device according to the present invention can also be adapted to other drilling methods, such as turbo drilling, etc.

The invention is not limited to the embodiments disclosed hereinabove, but can be modified in many respects within the scope of the invention as defined by the appended claims.

I claim:

1. A method for exchanging a bottommost drill bit of a drilling device for an uppermore drill bit at a bottom of a drill hole drilled in the ground by the bottommost drill bit, the drilling device having the drill bits interconnected in a row, the bottommost drill bit facing the bottom of the drill hole for decomposing the ground and the uppermore drill bit being connected to a drilling rod for rotating the drilling device, the method comprising the steps of:

providing a ring-shaped groove pocket about side surfaces of a drill hole, coaxially with the drill hole and at least adjacent a bottom of the drill hole by rotating a bottommost drill bit of a drilling device against the side surfaces of the drill hole;

placing the bottommost drill bit of the drilling device into the pocket; and releasing the bottommost drill bit while so placed for exposing an uppermore drill bit of the drilling device previously positioned above the bottommost drill bit of the drilling device and continued drilling at the bottom of the drill hole with the uppermore drill bit.

2. The method of claim 1, wherein:

placing the bottommost drill bit in the pocket comprises placing the same in an eccentric position by activation of an eccentric device eccentrically connecting the bottommost drill bit with the drilling device; and providing the pocket comprises rotating the drilling device for the eccentrically positioned bottommost drill bit to act upon the side surfaces of the drill hole.

3. The method of claim 1, wherein releasing the bottommost drill bit while placed in the pocket comprises actuating a releasing device that releasably connects the bottommost drill bit with the drilling device.

4. A drilling device, comprising:

at least a bottommost and an uppermore drill bit in a row, the bottommost drill bit being for facing a bottom of a drill hole, each of the drill bits being for decomposing ground at the bottom of the drill hole when facing the ground and rotated; and interconnecting means for interconnecting the drill bits in the row and connecting the uppermore drill bit to a rotating drilling rod having a rotational axis, whereby the drill bits are rotated with the drilling rod, the interconnecting means comprising:

eccentric means activatable for eccentrically connecting the bottommost drill bit with the uppermore drill bit and, with the rotation of the drill bits, for placing the bottommost drill bit in an eccentric position offset from the rotational axis of the drilling rod, thereby allowing the rotating bottommost drill bit to act upon side surfaces of the drill hole for providing a ring-shaped groove pocket about the side surfaces of the drill hole, coaxially with the drill hole and at least adjacent the bottom of the drill hole; and releasing means for releasing the bottommost drill bit into the pocket, whereby the uppermore drill bit is exposed for the decomposing of the ground at the bottom of the drill hole.

5. The drilling device of claim 4, wherein the eccentric means comprises:

a first plate connected to the bottommost drill bit and second plate connected to the uppermore drill bit;

an eccentrically arranged shaft releasably and pivotably connecting the first plate with the second plate;

at least one other shaft releasably connecting the first and second plates; and an activation means activatable for releasing the other shaft from the second plate, whereby the first plate is connected to the second plate only by the eccentrically arranged shaft for the eccentric connection of the drill bits.

6. The drilling device of claim 5, wherein the activation means comprises a head connecting the other shaft to the second plate and a remotely controlled locking means for separating the head from the second plate.

7. The drilling device of claim 4, wherein the releasing means comprises an axle pin having an essentially rectangular cross section connected to one of the drill bits and a sleeve connected to the other of the drill bits, receiving the axle pin and having a slit with a dimension corresponding to a narrowest dimension of the cross section of the axle pin, whereby the axle pin can pass through the slit only when the slit is aligned with the narrowest dimension of the axle pin.

8. The method of claim 2, wherein releasing the bottommost drill bit while placed in the pocket comprises actuating a releasing device that releasably connects the bottommost drill bit with the drilling device.

9. The drilling device of claim 5, wherein the releasing means comprises an axle pin having an essentially rectangular cross section connected to one of the drill bits and a sleeve connected to the other of the drill bits, receiving the axle pin and having a slit with a dimension corresponding to a narrowest dimension of the cross section of the axle pin, whereby the axle pin can pass through the slit only when the slit is aligned with the narrowest dimension of the axle pin.

10. The drilling device of claim 6, wherein the releasing means comprises an axle pin having an essentially rectangular cross section connected to one of the drill bits and a sleeve connected to the other of the drill bits, receiving the axle pin and having a slit with a dimension corresponding to a narrowest dimension of the cross section of the axle pin, whereby the axle pin can pass through the slit only when the slit is aligned with the narrowest dimension of the axle pin.

* * * * *